United States Patent [19]

Artz et al.

[11] Patent Number: 4,679,612

[45] Date of Patent: Jul. 14, 1987

[54] GUIDE ASSEMBLY FOR A TWIN-BELT CONTINUOUS CASTING MOLD

[75] Inventors: Gerd Artz, Ratingen; Dieter Figge, Essen; Clemens Philipp, Meerbusch, all of Fed. Rep. of Germany

[73] Assignee: Fried. Krupp Gesellschaft mit beschränkter Haftung, Essen, Fed. Rep. of Germany

[21] Appl. No.: 805,706

[22] Filed: Dec. 6, 1985

[30] Foreign Application Priority Data

Dec. 7, 1984 [DE] Fed. Rep. of Germany ..... 3444689

[51] Int. Cl.[4] ..... B22D 11/06

[52] U.S. Cl. ..... 164/431; 164/432

[58] Field of Search ..... 164/430, 431, 432, 481

[56] References Cited

U.S. PATENT DOCUMENTS

| | | | |
|---|---|---|---|
| 3,426,836 | 2/1969 | Altenpohl et al. | 164/432 |
| 4,190,103 | 2/1980 | Sivilotti et al. | 164/432 |
| 4,193,440 | 3/1980 | Thorburn et al. | 164/432 |
| 4,552,201 | 11/1985 | Wood | 164/481 |

FOREIGN PATENT DOCUMENTS

| | | | |
|---|---|---|---|
| 1758957 | 4/1971 | Fed. Rep. of Germany . | |
| 1433036 | 9/1971 | Fed. Rep. of Germany . | |
| 1558259 | 3/1974 | Fed. Rep. of Germany . | |
| 58-110161 | 6/1983 | Japan | 164/432 |
| 58-110163 | 6/1983 | Japan | 164/432 |

*Primary Examiner*—Nicholas P. Godici
*Assistant Examiner*—Richard K. Seidel
*Attorney, Agent, or Firm*—Spencer & Frank

[57] ABSTRACT

A twin-belt continuous casting mold has a guide assembly for the casting belts; the guide assembly includes a plurality of support rollers arranged serially parallel to the casting direction and engaging each casting belt along the mold chamber, and additional ribbed supports transversely engaging each casting belt in a zone upstream of the first support roller as viewed in the casting direction. There is provided a first resilient holding arrangement for positioning each additional support and resiliently urging it into engagement with a respective casting belt. The support rollers form a first and a second group; the first group is situated in a zone of the mold entrance adjacent the respective additional ribbed support downstream thereof. The guide assembly further has a second resilient holding arrangement for positioning each support roller of the first group for resiliently urging each such support roller into engagement with a respective casting belt. The second group of support rollers is situated downstream of the first group and is rigidly held. Each roller of the first and second groups has a supporting portion provided with an arcuate outer contour being convex towards the mold chamber and being oriented parallel to the mold chamber width. There are further provided side dam support means, especially in the form of support rails or rolls, extending parallel to the casting direction and flanking the support rollers of the first group and engaging the casting belts in alignment with the side dams which laterally bound the mold chamber.

5 Claims, 10 Drawing Figures

GUIDE ASSEMBLY FOR A TWIN-BELT CONTINUOUS CASTING MOLD

BACKGROUND OF THE INVENTION

This invention relates to a guide assembly for guiding the casting belts of a twin-belt continuous casting mold. The casting belts bound the mold chamber at the top and bottom, while the mold chamber is laterally bounded by segmented side dams which adjoin the casting belts. In the zone of the mold entrance and mold outlet, there are provided respective upstream and downstream end drums for positioning and supporting the casting belts and between the upstream and the downstream end drums there is arranged a series of support rollers which engage the respective casting belt opposite the mold chamber. Between the end drums at the mold inlet (the upstream end drums) and the first support roller downstream thereof, as viewed in the casting direction, with each casting belt there is associated a ribbed additional support which engages the respective casting belt transversely to the casting direction in the zone of the mold chamber and the side dams.

In the casting of non-ferrous metals—particularly copper, aluminum and zinc—the molten metal is introduced into the mold chamber by means of an open, trough-like tundish whereby in the inlet (entrance) zone of the mold chamber only the lower casting belt is stressed, and such stresses are derived mainly from the weight of the molten metal. Only in the mid zone or the outlet zone of the mold chamber which is inclined slightly downwardly from the horizontal, is a ferrostatic pressure present which exerts pressure forces, with the intermediary of the casting skin, on all mold walls and thus also on the segmented side dams.

If, for the purpose of achieving a high-quality product, molten steel is introduced into the mold chamber from an intermediate vessel through a tubular casting nozzle with the exclusion of air, all mold walls are exposed to a ferrostatic pressure already in the inlet zone of the mold chamber. Such ferrostatic pressure may reach 0.75 bar, dependent upon the parameters of the molten column.

Twin-belt continuous casting molds are usually equipped with an upper frame and a lower frame carrying the upper and lower casting belts, respectively. The frames are supported on one another by means of spacer pins. A clearance in the order of magnitude of up to 0.1 mm set by this arrangement between the lower edge of the support rollers of the upper casting belt and the upper casting belt is needed to allow compensation for lateral displacements of the two casting belts by a lateral edge guidance and for shrinkages within the mold chamber by an inclined positioning of the guide arms for the side dams. Disadvantageously, in these prior art constructions the molten steel under pressure penetrates in the inlet zone of the mold chamber into the clearance between the upper casting belt and the side dams, solidified in the clearance to form thin, torque-like deposits and thereby increases the height of the side dams. Upon passage of the subsequent support rollers the upper frame of the twin-belt continuous casting mold is lifted whereupon, as a result, the sealing gap set between the casting nozzle and the mold chamber increases, allowing the molten steel to escape which necessitates the interruption of the casting operation.

The formation of the tongue-like deposits—whose initial thickness of 0.3 to 0.5 mm is several times greater than the height of the clearance set by the above-noted spacer pins—is, pursuant to the recognition on which the invention is based, caused preponderantly by the temperature distribution prevailing within the casting belts. As a result of the cooling of the casting belts, their lateral zones, externally of the mold chamber, remain cold during the casting process, while the central zones in the region of the mold chamber have an average temperature which is at least 100° C. higher. Further, the casting belt temperature prevailing in the zone of the mold chamber increases by more than 100° C. in the direction of belt travel. This non-uniform temperature distribution in the transverse and longitudinal directions of the casting belts and the resulting different length variations (particularly if the distance between the upstream and the downstream end drums is more than 4 m) lead, in the absence of particular measures, to uncontrollable casting belt deformations in the zone of the casting chamber (that is, in the zone between the side dams) which allow a penetration of the molten steel between the casting belt and the side dams.

An appearance of unsealed locations between the mold walls is in some instances also caused by the fact that the components cooperating in the zone of the mold chamber (such as casting belts, side dams, support rollers and support roller bearings) necessarily have to be manufactured and installed with tolerances. The thus-resulting deviations add up in disadvantageous cases such that in the longitudinal direction of the mold chamber between the casting belts and the side dams there may appear gaps in the order of magnitude of several tenths of a millimeter in a non-uniform distribution.

German Auslegeschrift (Published Examined Application) No. 1,433,036 discloses a guide assembly of the above-outlined type which, at the mold chamber inlet, in the zone behind the end drums is equipped with additional supports constituted by additional ribbed support rollers which support the upper and the lower casting belts while projecting in part into the upstream end drums. The additional support rollers as well as the other support rollers, however, are immovably supported at the associated upper or lower frame of the twin-belt continuous casting mold and therefore they are incapable of preventing the above-noted casting belt deformations and the appearance of gaps as well as the disadvantages resulting therefrom.

German Auslegeschrift No. 1,558,259 and German Offenlegungsschrift (Published Non-examined Application) No. 1,758,957 propose to support the endless casting belts of continuous casting molds between the end drums by means of resiliently positioned support rollers. The disclosed embodiments, however, have a vertically oriented mold chamber with four bounding casting belts and are equipped with a tubular mold immediately succeeding the casting belts resulting in the formation of a load supporting casting skin. The prior art is not concerned with arrangements to improve the guide assembly at the casting belts of a twin-belt continuous casting mold equipped with side dams with a view towards operational safety.

SUMMARY OF THE INVENTION

It is an object of the invention to provide an improved guide assembly of the above-outlined type while taking into consideration particularly the unavoidable non-uniform temperature distribution in the casting belts. The required seal between the casting belts and the side dams, particularly in the critical inlet zone of the mold chamber is to be ensured—independently from possible unfavorable tolerances—even if the mold walls are exposed already at the inlet zone of the mold chamber to a ferrostatic pressure which, under certain conditions, may be of significant magnitude.

It is a further object of the invention to provide an improved guide assembly of the above-outlined type such that setting operations in the zone of the mold chambers (lateral edge control of the casting belts, shrinkage compensation by the inclined positioning of guide arms of the side dams) and temperature-dependent dimensional changes of the side dams are not appreciably interfered with.

These objects and others to become apparent as the specification progresses, are accomplished by the invention, according to which, briefly stated, the twin-belt continuous casting mold has a guide assembly for the casting belts; the guide assembly includes a plurality of support rollers arranged serially parallel to the casting direction and engaging each casting belt along the mold chamber, and additional ribbed supports transversely engaging each casting belt in a zone upstream of the first support roller as viewed in the casting direction. There is provided a first resilient holding arrangement for positioning each additional support and resiliently urging it into engagement with a respective casting belt. The support rollers form a first and a second group; the first group is situated in a zone of the mold entrance adjacent the respective additional ribbed support downstream thereof. The guide assembly further has a second resilient holding arrangement for positioning each support roller of the first group of resiliently urging each such support roller into engagement with a respective casting belt. The second group of support rollers is situated downstream of the first group and is rigidly held. Each roller of the first and second groups has a supporting portion provided with an arcuate outer contour being convex towards the mold chamber and being oriented parallel to the mold chamber width. There are further provided side dam support means extending parallel to the casting direction and flanking the support rollers of the first group and engaging the casting belts in alignment with the side dams which laterally bound the mold chamber, the side dam support means consisting especially of support rails or of rolls which succeed one another in the casting direction.

Thus, the invention is based on the principle that at each casting belt, between the respective upstream end drum at the mold chamber entrance and the first support roller downsptream thereof, as viewed in the direction of casting, there is provided an additional support constituted by a support carrier in the form of a beam or a plate which resiliently supports the respective casting belt in the zone of the mold chamber and the side dams in a direction transversely to the casting direction (that is, in a direction transversely to the length dimension of the casting belt). This arrangement presents countermeasures to prevent the appearance of undesired unsealed locations between the casting belts and the side dams immediately downstream of the respective upstream end drum. The entrance support rollers adjoining the support carriers situated in the entrance zone of the mold chamber are held resiliently in the zone between the side dams and the respective casting belt. The entrance zone (corresponding to the travel length which the molten metal requires for the formation of a sufficiently load-supporting casting skin) along which the resilient entrance support rollers extend, corresponds at the most of the first quarter of the length of the mold chamber, as viewed in the casting direction. By virtue of the resilient arrangement of the support carriers and the successive entrance support rollers it is ensured that—independently from the non-uniform casting belt deformations and tolerances between the cooperating components—between the casting belts and the side dams no gap may appear into which the molten metal could penetrate. This arrangement is of particular significance in case the molten metal is liquid steel which has a particularly low viscosity. All support rollers of each casting belt, that is, the resiliently supported entrance support rollers and the subsequent rigid support rollers, have supporting portions of an outwardly convex contour (that is, they are cross-sectionally convex towards the mold chamber); the supporting portions are shorter than the width of the mold chamber. The entrance support rollers pretension the casting belts only along their outwardly arcuate support portion in the direction of the longitudinal axis of the mold chamber. Adjacent to these supporting portions there are arranged additional side dam support means (support rails, rolls) which engage that side of the respective casting belt which is oriented away from the side dams. In contradistinction, the rigid support rollers arranged in a series in the casting direction are so designed that they also support the casting belts in the zone of the side dams, thus, also externally of their outwardly convex supporting portions.

The resilient support of the casting belts results particularly in that the casting belts are, over the length of the entrance portion of the mold chamber, additionally biased in the direction of the longitudinal axis of the mold chamber and thus assume a predetermined position. For all practical purposes this arrangement prevents the appearance of uncontrollable bulging and deformations of the casting belts in different directions. The outwardly convex contour of the supporting portions results in that the associated casting belt first engages only the central zone of the supporting portion. By virtue of the progressive heating in the casting direction and the resulting deformation, the respective casting belt is, under the effect of the outwardly convex supporting portions, pressed arcuately to the necessary extent in the direction of the longitudinal axis of the mold chamber inwardly, whereby an undesired and uncontrollable snap-over of the casting belts from a convex cross-sectional shape to a concave cross-sectional shape is prevented.

The support rails (and in corresponding manner the rolls acting as side dam support means) which cooperate with the resilient entrance support rollers are preferably held in such a manner that their position relative to the casting belts and the side dams may be changed steplessly in the vertical direction. For this purpose the support rails may be secured by setscrews by means of which, if necessary, a distance in the order of magnitude of at least a few hundredths of a millimeter may be set relative to the associated casting belt.

The required mobility of the support carriers and the subsequent entrance support rollers is effected in a simple manner by holding these guide components in straight-lined guides, especially composed by guide pins. According to an advantageous feature of the invention, the support carriers and the entrance support rollers are held on rockers which are pivotal about stationary pivotal axes in a plane which is perpendicular to the respective casting belt. The required pressing force in the direction of the casting belts to be supported is preferably generated by spring disc stacks by means of which the guide components in question engage the stationary environment (that is, the upper or lower frame of twin-belt continuous casting mold). Expediently, the movable guide components are designed in such a manner that the pressing forces generated thereby may be varied in a stepless manner. In order to ensure that the mold walls, while maintaining a sufficient sealing effect of the mold chamber, may also move to the required extent transversely to the longitudinal dimension, the pressing force should just have the sufficient magnitude to hold the casting belts on the side dams despite the non-uniform temperature distribution in the casting belts during the casting process.

A superior alignment of the support carrier relative to the casting belts is accomplished according to another feature of the invention by providing that the support carriers are connected with their associated rockers by means of ball joints. The support of the casting belts immediately after the upstream end drums is achieved by providing that the support carriers are adapted, at their end face oriented towards the end drums, to the shape of the end drums.

DESCRIPTION OF THE PREFERRED EMBODIMENT

Figure 1:
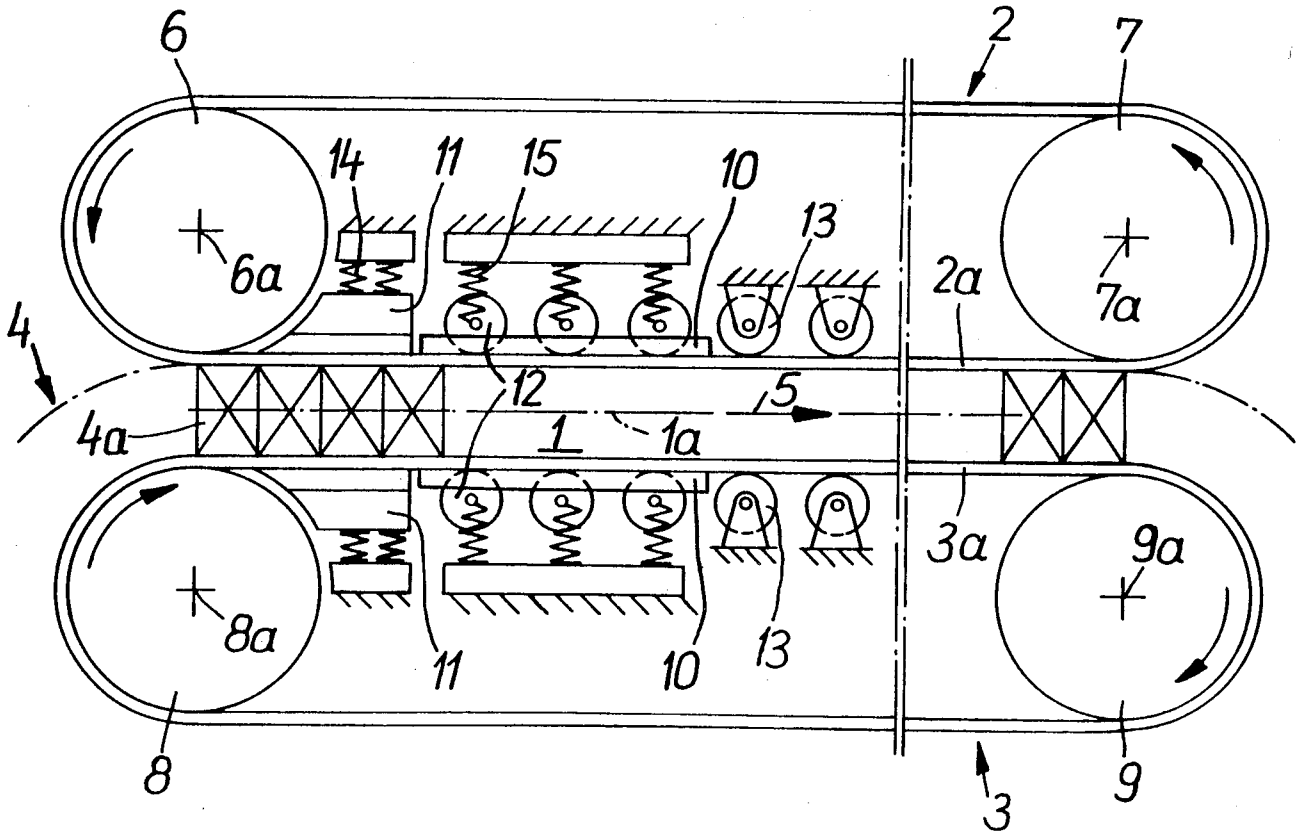
FIG. 1 is a schematic side elevational view of a preferred embodiment of the invention.

Turning now to FIG. 1, a twin-belt continuous casting mold schematically illustrated therein comprises a mold chamber 1 which has a longitudinal axis 1*a* and which is bounded at the top and at the bottom by endless respective casting belts 2 and 3 and is bounded laterally by two endless segmented side dams 4 (only one shown) which are formed of block-shaped dam members (segments) 4*a*. The side dams 4 extend, in the zone of the mold chamber, between the casting belts 2 and 3.

The casting mold walls 2, 3 and 4 move in the zone of the mold chamber 1 codirectionally with the casting direction, that is, from the left towards the right as viewed in FIG. 1 and as indicated by the arrow 5. In the zone of the mold entrance and mold outlet, the upper casting belt 2 is supported by an upstream end drum 6 and a downstream end drum 7 while the lower casting belt 3 is supported by an upstream end drum 8 and a downstream end drum 9. The end drums 614 9 have respective, stationarily supported rotary shafts 6*a*, 7*a*, 8*a* and 9*a*. Corresponding to the casting direction 5, the upper end drums 6 and 7 rotate counterclockwise while the lower end drums 8 and 9 rotate clockwise.

The molten steel to be processed is introduced into the mold chamber 1 in the zone defined between the upstream end drums 6 and 8 by a tubular casting nozzle (not shown) whereupon, starting from the mold walls 2, 3 and 4, a casting skin which thickens in the casting direction is formed, leaving the mold chamber 1 in the zone defined by the downstream end drums 7 and 9 as a sufficiently solidified casting.

For supporting the casting belt portions 2*a* and 3*a* which bound the mold chamber 1 from above and, respectively, from below, there are provided in a consecutive series the following guide components adjoining the upstream end drums 6 and 8 in the casting direction: resiliently held support carriers 11 which function as additional supports, a plurality of resiliently held, movable entrance support rollers 12 and stationary support rollers 13 which extend to the vicinity of the downstream end drums 7 and 9.

The support carriers 11 are, at their end face oriented towards the upstream end drums 6 and 8, adapted to the shape of the associated end drum so that they are capable of supporting the casting belt portions 2*a* and 3*a* in the immediate vicinity of the end drums.

All guide components 11, 12 and 13 are connected either resiliently (by spring elements 14 or 15) or rigidly with the upper or lower frame of the twin-belt continuous casting mold. In accordance with their intended purpose, the movable (resiliently supported) guide components 11 and 12 have a guide arrangement which essentially permits guide motions only transversely to the longitudinal dimension of the casting belt portions 2*a* and 3*a*. Guide motions of the guide components 11 and 12 in the direction of the mold chamber 1 may be realized in a particularly simple manner by holding these components in a guide track (not shown) which extends perpendicularly to the plane of the associated casting belt portion. As it will be described below, all support rollers, that is, the resilient entrance support rollers 12 and the stationary (rigid) support rollers 13 have outwardly convex supporting portions which are shorter than the width of the mold chamber.

For supporting the casting belt portions 2*a* and 3*a* on the side dams (that is, on the dam segments 4*a*) there are provided (as side dam support means), adjacent the supporting portions of the entrance support rollers 12, height adjustable support rails 10 which are secured stationarily to the upper and, respectively, lower frame and which extend to the end of the entrance portion of the mold chamber 1.

Figure 4A:
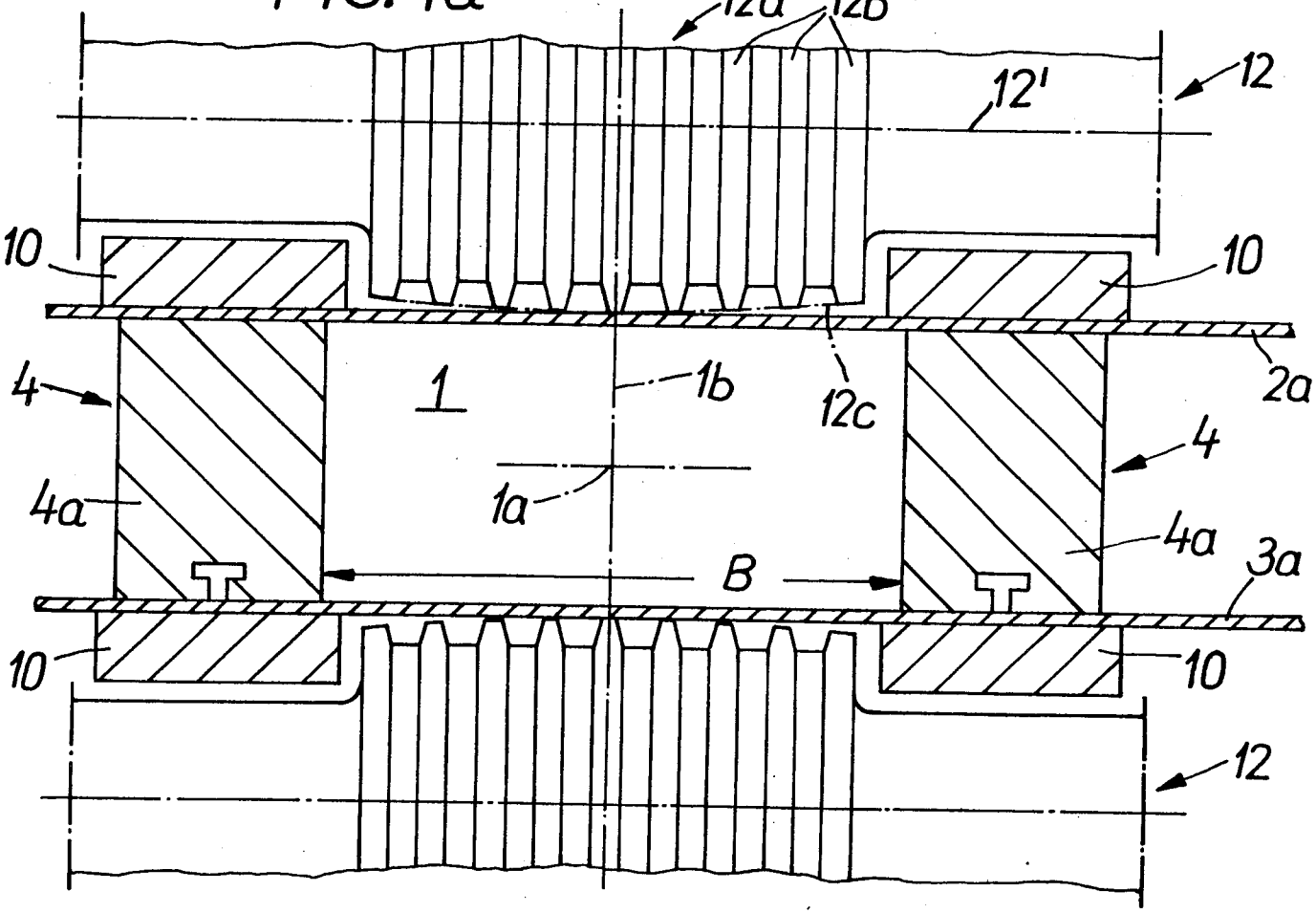
FIG. 4*a* is a front elevational view of a detail of the preferred embodiment before the beginning of operation.
Figure 4B:
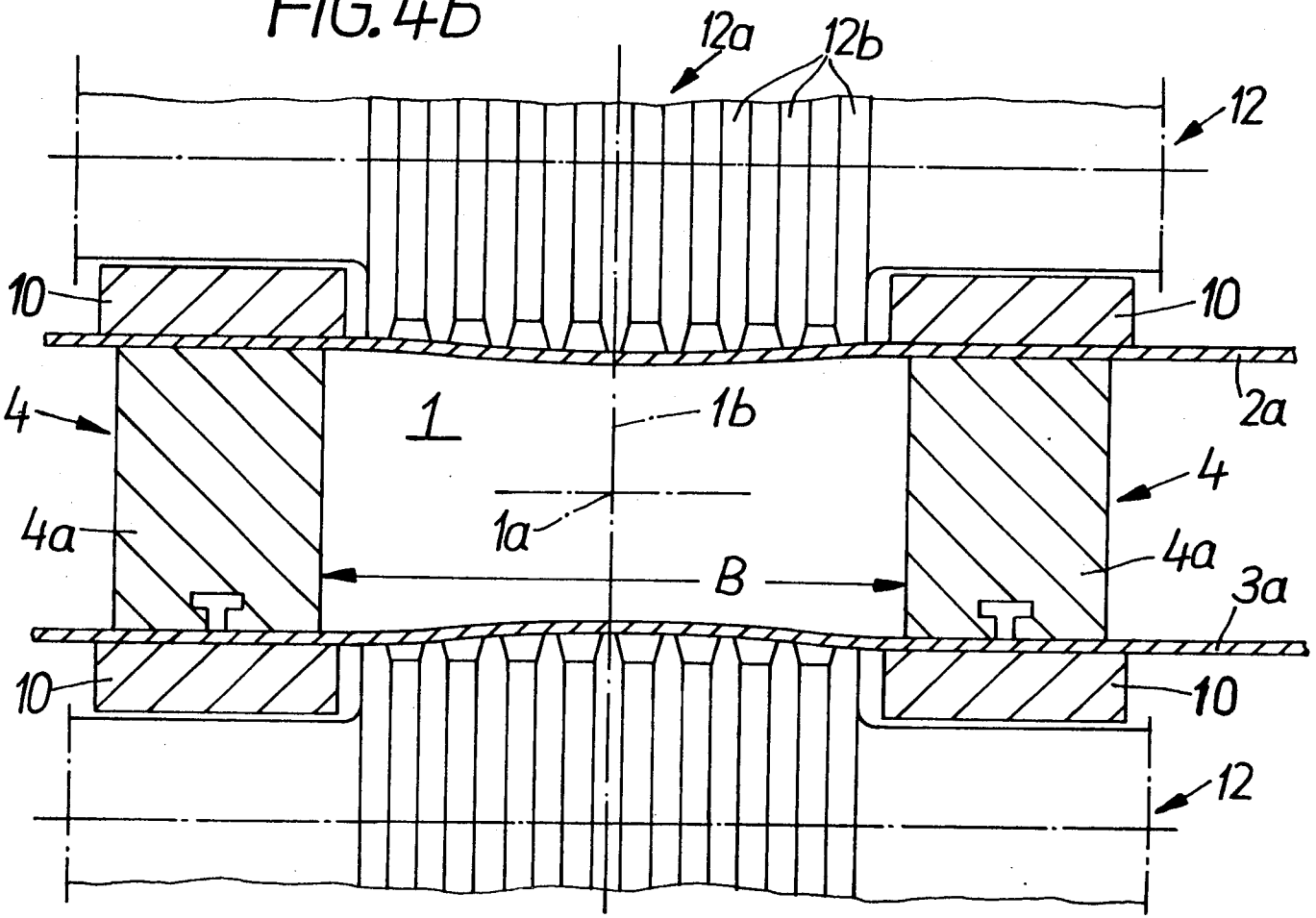
FIG. 4*b* is a view similar to FIG. 4*a*, showing the construction during operation.

Those portions (outer portions) of the rigid support rollers 13 which are situated in alignment with the side dams 4 relative to the casting belt portions 2*a* and 3*a* have support ribs forming a cylindrical outer contour. The diameter of the outer contour is so dimensioned that the respective casting belt portion is held thereby on the side dams permitting only a small play, if any. The supporting effect of the stationary support rollers 13 thus also entends—in contrast with the resiliently held entrance support rollers 12—to those casting belt portions which project beyond the width B of the mold chamber (FIGS. 4*a*, 4*b*).

Figure 2A:
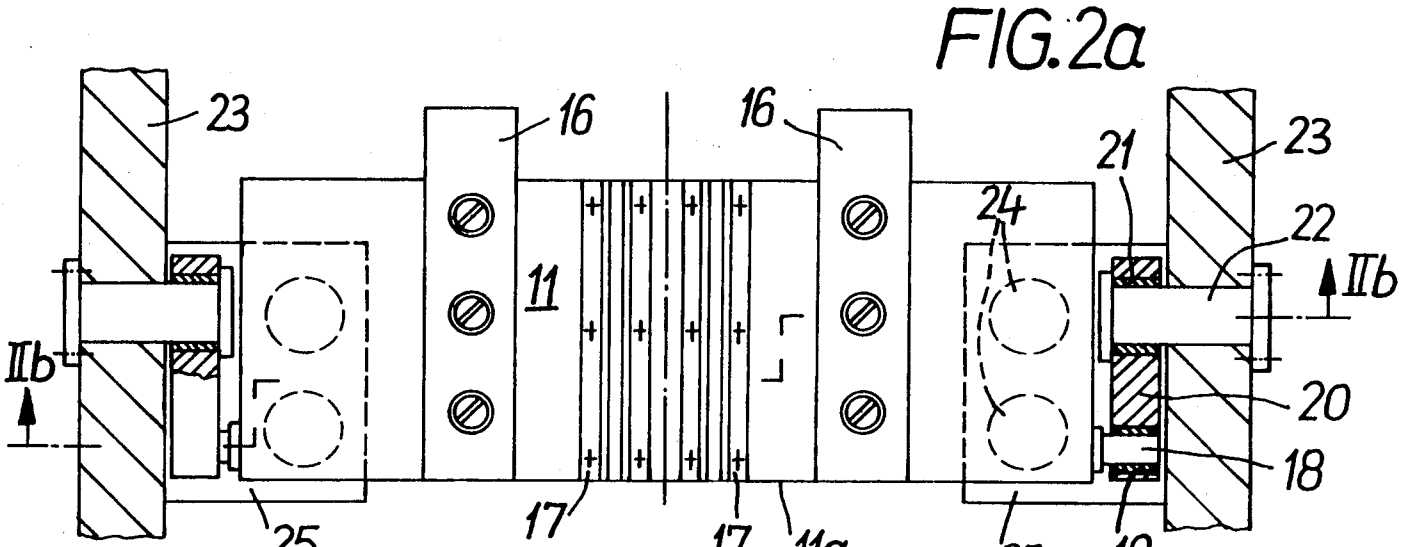
FIG. 2*a* is a bottom plan view of a detail of the preferred embodiment, on an enlarged scale relative to FIG. 1.
Figure 2B:
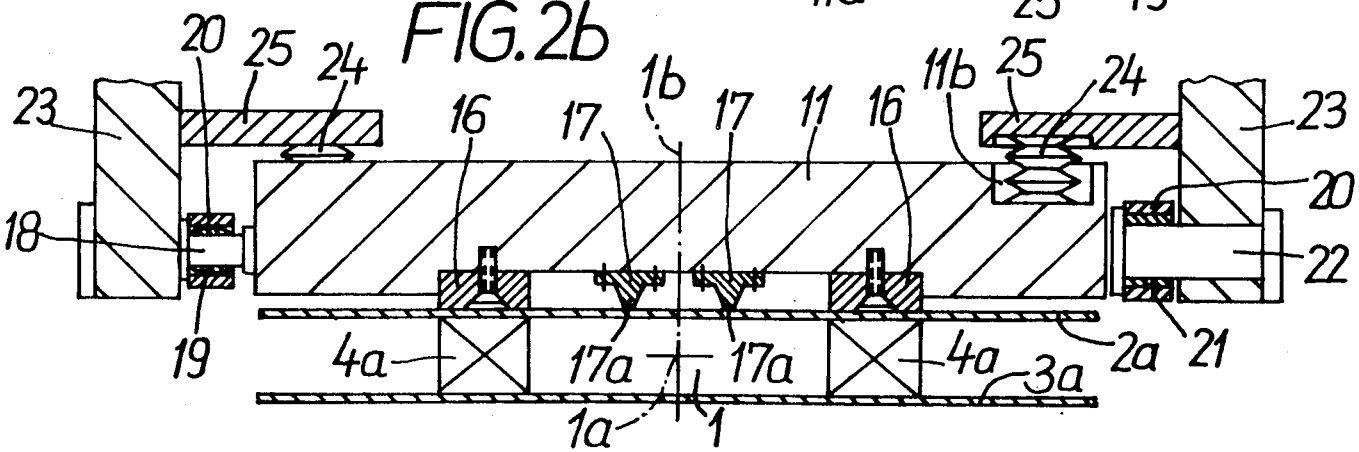
FIG. 2*b* is a sectional view taken along line IIb—IIb of FIG. 2*a*.

Turning now to FIGS. 2*a* and 2*b*, there is illustrated a preferred embodiment of the support carrier 11 and the mechanism for its positioning. The FIGS. 2*a*, 2*b* illustrate the construction associated with the upper casting belt 2 which is not seen in FIG. 2*a* for reasons of clarity. To the movably held support carrier 11 there are secured by screws two wide support strips 16 and two narrow webbed strips 17. The support strips 16 are so oriented that they engage the casting belt portions 2*a* above the dam segments 4*a*. The web 17*a* of the webbed strips 17 support the casting belt portion 2*a* in the zone of the vertical halving plane 1*b* passing through the mold chamber 1 and the dam segments 4*a*, as shown in FIG. 2*b*.

The support carrier 11 is equipped in the vicinity of its frontal downstream end 11*a* with laterally projecting pins 18 which journal in separate rockers 20 with the intermediary of support sleeves 19 having a spherical outer surface to thus form a ball joint. Each rocker 20 is pivotally supported in a bearing sleeve 21 of a carrier pin 22 which, externally of the zone of the casting belt portion 2*a*, is connected by screws with the upper frame 23 of the twin-belt continuous casting mold.

The resilient engagement of the support strips 16 and webbed strips 17 on the casting belt portions 2*a* is effected by spring disc stacks 24 which project into recesses 11*b* on the upper side of the support carrier 11 and which engage an arm 15 secured above the support carrier 11, with a distance therefrom, on the upper frame 23.

Under the effect of the biased spring disc stacks 24 the support carrier 11 may execute guided motions relative to the casting belt portions 2*a*; these guided motions are determined by the limits of mobility of the two rockers 20. The swivel connection between the rockers 20 and the support carrier 11 provides that the latter can set themselves at all times parallel to the casting belt portion 2*a* to be supported. The length of the support carrier 11 in the casting direction is, as seen in FIG. 1, preferably greater than the mutual distance between two consecutive entrance support rollers 12 or two consecutive stationary support rollers 13. The design, arrangement and mode of operation of the support carrier 11 for the casting belt portion 3*a* of the lower casting belt 3 is identical to the above-described arrangement; such a support carrier 11, with the associated components, is situated underneath the casting belt portion 3*a* and is movably secured to the non-illustrated lower frame of the twin-belt continuous casting mold.

The cooperation between the two support carriers 11 held resiliently in the upper and lower frames ensures that the casting belt portions 2*a* and 3*a* engage continuously and hermetically the dam segments 4*a* of the side dams 4. The possibility of a penetration of the molten steel into the zone between the casting belt portions and the dam segments is therefore excluded as long as the spring disc stacks 24 of the support carrier 11 exert a sufficiently large pressing force on the upper and lower casting belts 2 and 3 with the intermediary of the support strips 16.

Figure 3A:
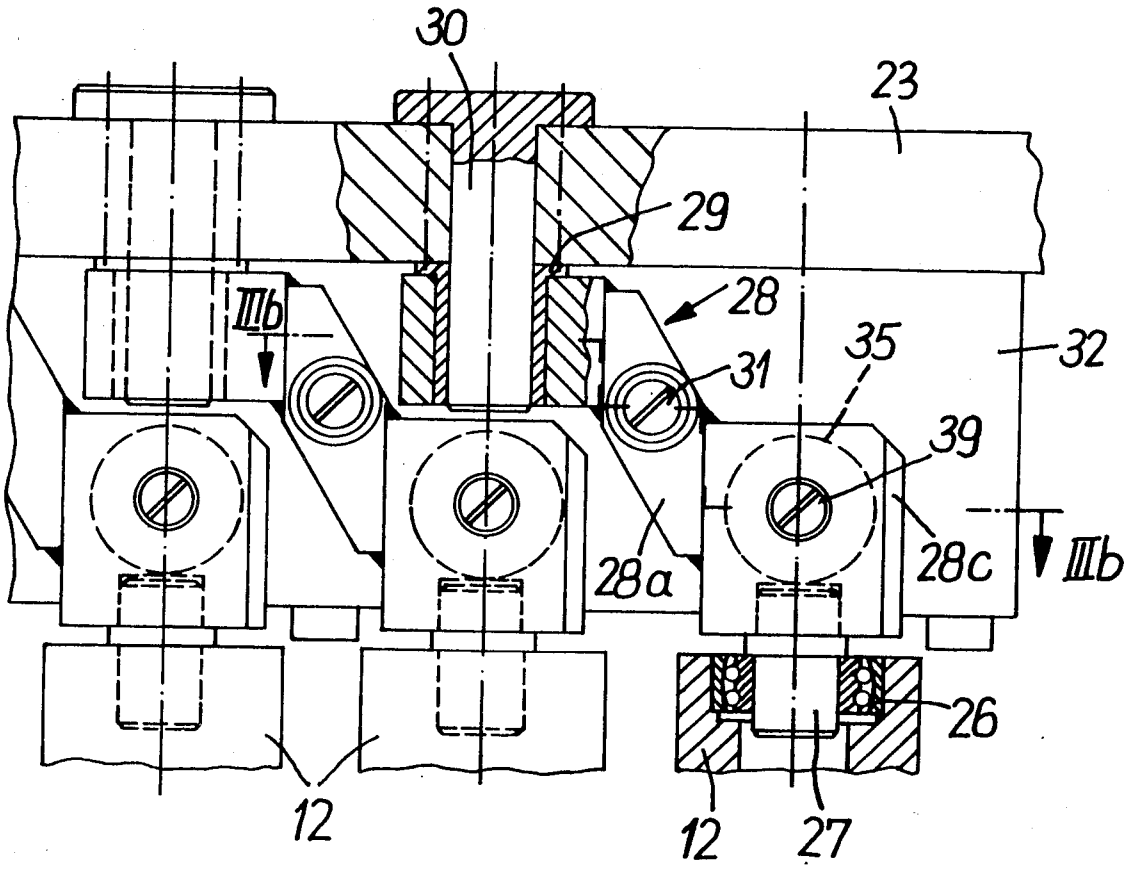
FIG. 3*a* is a partially sectional bottom plan view of a detail of the preferred embodiment.
Figure 3B:
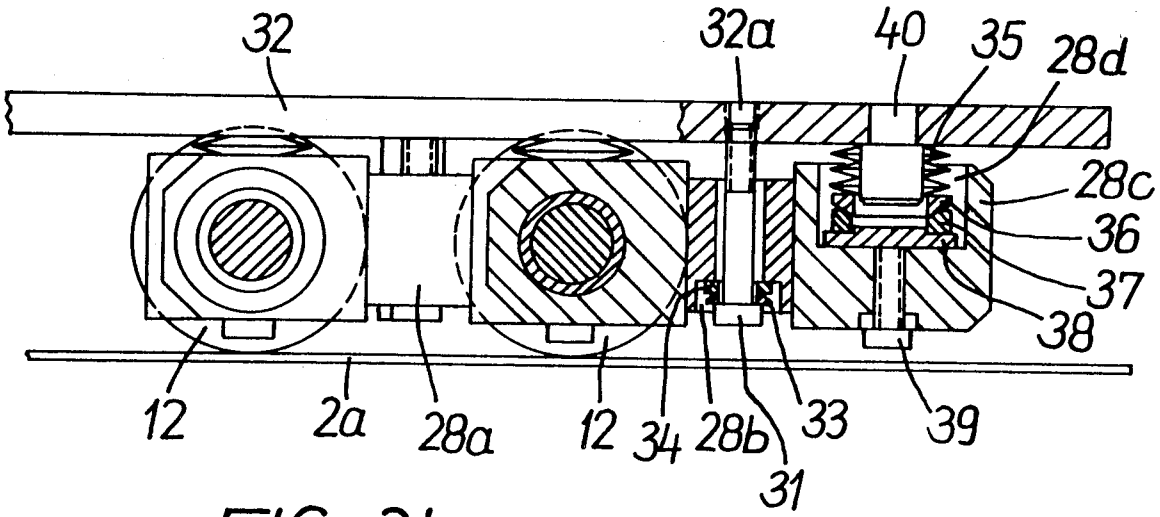
FIG. 3*b* is a sectional view taken along line III—IIIb of FIG. 3*a*.

Turning now to FIGS. 3*a* and 3*b*, the entrance support rollers 12 shown therein for engaging the casting belt portions 2*a* of the upper casting belt 2, are held on rockers 28 by means of swivellable roller bearings 26 and bearing pins 27. The rockers 28 are rotatable in bearing sleeves 29 about bearing pins 30 which are affixed by a screw connection to the upper frame 23 of the twin-belt continuous casting mold. The lateral play of the rockers 28 may be varied by means of setscrews 31 which pass through the mid portion 28*a* of the respective rocker 28 with a clearance (as shown in FIG. 3*b*) and which are held in threaded bores 32*a* of a console 32. The latter straddles the intermediate space between the entrance support rollers 12 and the upper frame 23 to which it is secured.

The setscrews 31 engage into a recess 28*b* of the mid part 28*a* of each rocker 28 by means of a jointed support formed of two discs 33, 34 with convex and, respectively, concave contact faces.

Each rocker 28 has in its inside end portion 28*c* connected with the bearing pin 27 a recess 28*d* which receives a spring disc stack 35. The latter engages a tensioning screw 39 held in the terminal portion 28*c*, with the intermediary of two centering discs 36 and 37 which have convex and, respectively, concave contact faces. Between the lower centering disc 37 and the end of the screw 39 there is positioned a tensioning plate 38 seated on the base of the recess 28*d*. The centering of the spring disc stack 35 is effected by centering pins 40 secured to the console 32. The spring bias of the spring disc stack 35 can be steplessly varied by rotating the tensioning screw 39. The terminal position of each rocker 28 and the associated entrance support roller 12 may be set by rotating the setscrew 31.

The number and arrangement of the entrance support rollers 12 held movably at the casting belt portion 2*a* are so selected that they perform their supporting function along the entire entrance portion of the mold chamber 1. The entrance portion extends at the most through the first quarter of the length of the mold chamber 1.

The pressing force exerted by the spring elements 14 and 15 (FIG. 1) and the spring disc stacks 24 (FIG. 2*b*) and 35 (FIG. 3*b*) with the intermediary of the support carrier 11 and the entrance support rollers 12 is expediently so set that it biases the casting belt portion 2*a* and, in a similar manner, the casting belt portion 3*a* in the direction of the longitudinal axis 1*a* of the mold chamber 1 in such a manner that an uncontrolled snap-over of the non-uniformly expanding casting belt and thus the appearance of unsealed portions between the respective casting belt and the side dams is prevented. Under the pressing effect of the springing guide components 11 and 12 the respective casting belt portion is brought into and maintained securely in a determined position with respect to the side dams.

Turning now to FIGS. 4*a* and 4*b*, the entrance support rollers 12 have a supporting length portion 12*a* which is composed of side-by-side arranged support ribs 12*b* and which is shorter than the width B of the mold chamber 1. The support ribs 12*b* which thus support the casting belt portion 2*a* and, respectively, 3*a* only in the zone of the mold chamber 1, together form an outwardly convex contour 12*c* which extends perpendicularly to the casting direction and is thus oriented parallel to the width B. Stated differently, the circumferential crest surfaces of the ribs 12*a* together lie on an imaginary barrel-shaped shell whose axis coincides with the axis 12' of the respective entrance support roller 12.

Each stationary support roller 13 has a ribbed configuration similar to that of the resiliently held entrance support rollers 12.

The earlier-mentioned support rails 10 serve for supporting the casting belt portions 2*a* and 3*a* at the side dams 4 adjacent the support portions 12*a* of the entrance support rollers 12. The support rails 10 ensure that the casting belts 2*a* and 3*a* engage the dam segments 4*a* at the end of the support carrier 11 with a very small play, until the end of the entrance zone of the mold chamber 1.

Figure 5:
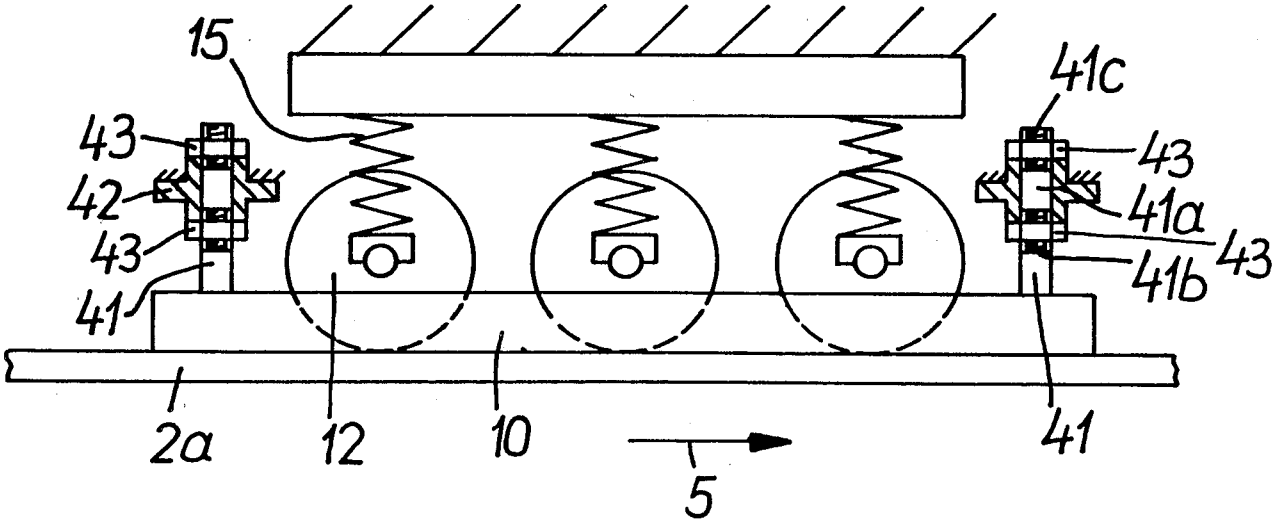
FIG. 5 is a schematic side elevational view of a detail of FIG. 1, on an enlarged scale relative to that of FIG. 1.

The support rail 10 shown in FIG. 5 is an exemplary manner for the upper casting belt portion 2*a* is equipped with two upwardly projecting guide pins 41 rigidly affixed thereto. The guide pins 41 have, above the support rail 10, two threaded portions 41*b* and 41*c* separated from one another by a central, non-threaded portion 41*a* which is movably guided in a console 42 and held thereon by means of two setting units 43 which threadedly engage the thread portions 41*b* and 41*c* and are held on different sides of the console 42. By rotating the setting nuts 43 the position of the guide rail 10 may be steplessly varied relative to the illustrated casting belt portion 2*a*.

The consoles 42, similarly to other stationary components of the guide assembly are attached to the upper frame 23 (and, on the lower frame, inasmuch as they effect the casting belt portion 3*a*). The length of the support rails 10 in the casting direction is so designed that they straddle the intermediate space between the support carrier 11 and the first stationary support roller 13 arranged downstream thereof (that is, in the casting direction 5), as shown in FIG. 1.

The illustration according to FIG. 4*a* shows the supporting effect of one entrance support roller 12 prior to the beginning of the casting operation. The casting belt portions 2*a* and 3*a* of the not-yet heated casting belts 2, 3 are still in an unexpanded condition and extend linearly over the width B of the mold chamber 1. The entrance support rollers 12 held resiliently cannot press the casting belt portions 2*a*, 3*a* in the direction of the mold chamber axis 1*a* and thus contact the casting belt portions only with those support ribs 12*b* which are situated in the vicinity of the vertical halving plane 1*b* passing through the mold chamber 1.

During the casting operation, the casting belt portions 2*a* and 3*a* undergo a heat expansion under the effect of the molten steel in the mold chamber 1. As a result, the entrance support rollers 12 execute a motion in the direction of the longitudinal axis 1*a* of the mold chamber 1 and engage, with the support ribs 12*b*, the casting belt portions between the side dams 4 against the pressure originating in the mold chamber 1, as shown in FIG. 4*b*. By virtue of the resilient engagement of the supporting portions 12*a* having an outwardly convex contour 12*c* it is ensured that the heat-expanded casting belt portions 2*a* and 3*a* are held continuously in a predetermined position relative to the dam segments 4*a*, thus preventing an undesired bulging as well as a reversal of the arcuate course of the casting belts. Thus, in this manner the appearance of non-sealed locations between the casting belt portions and the dam segments is prevented. A danger that the molten steel penetrates into the zone between the casting belt portions and the dam segments and forms there tongue-shaped deposits is further reduced by means of the support rails 10 which hold the casting belt portions directly on the dam segments 4*a* externally of the zone of the mold chamber 1. As soon as a casting with a sufficiently load-supporting skin is formed as the material moves in the casting direction in the mold chamber 1, the function of the support rails 10 is taken over by the outer portions of the stationary support rollers 13 (FIG. 1).

Figure 4C:
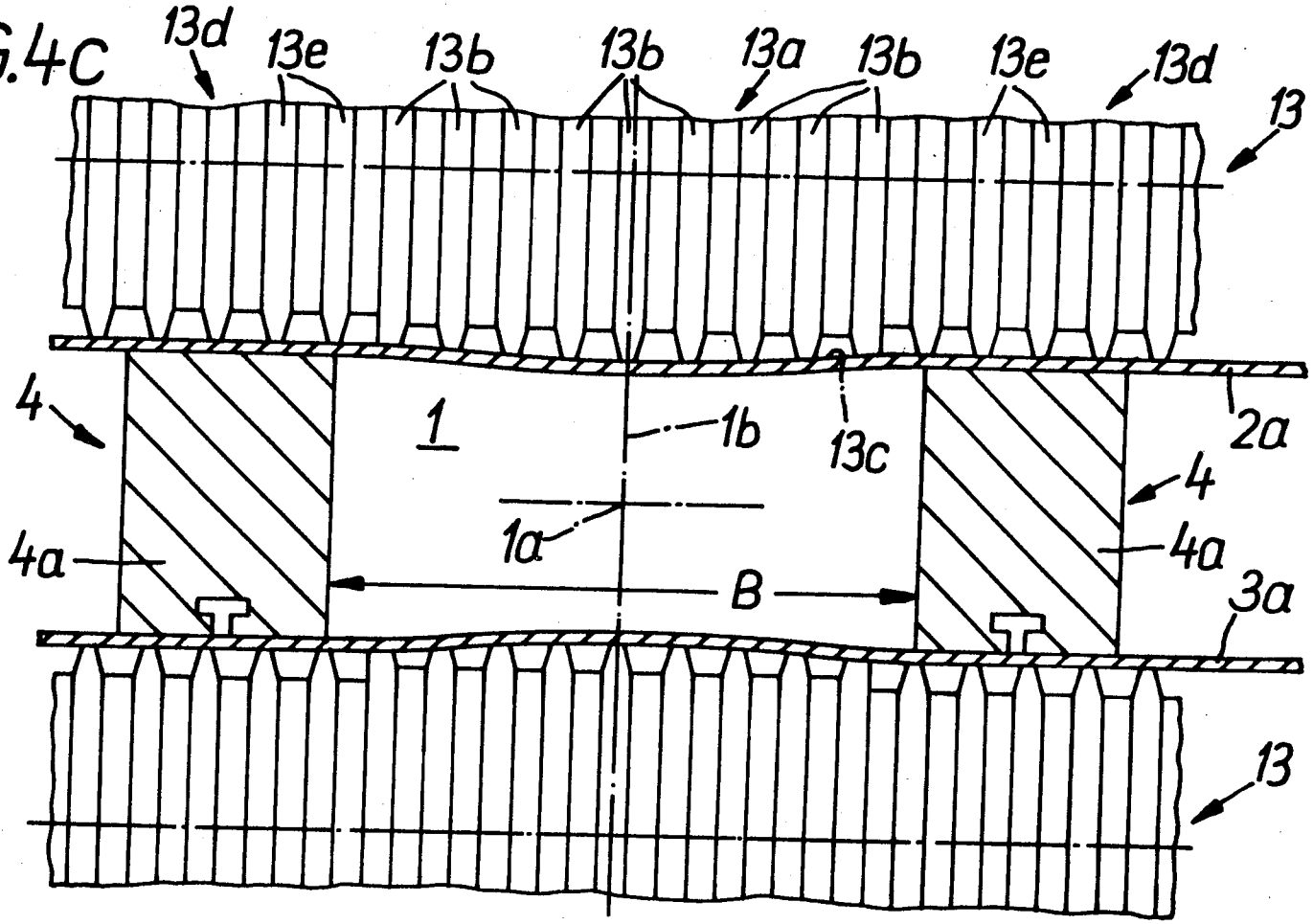
FIG. 4*c* is a front elevational view (similar to FIG. 4*b*) of the stationary support rollers shown in FIG. 1.

The advantage achieved by the use of the resiliently held support carriers and the entrance support rollers resides in the face that dimensional deviations between the components cooperating in the zone of the mold chamber and the heat-caused casting belt deformations cannot result in unsealed portions in the zone of the side dams. The casting belt deformations may be neutralized by means of the outwardly arcuate supporting portions at each support roller without the appearance of undesired sharp transitions. The outwardly arcuate supporting portions press inwardly the respective casting belt—which has progressively higher temperatures in the casting direction—in the direction of the longitudinal axis of the mold chamber, whereby undesired and uncontrollable snap-over motions of the casting belts are prevented. The guide assembly according to the invention may find particularly advantageous utilization in cases where the molten metal—particularly low viscosity molten metal such as liquid steel—is introduced into the mold chamber under pressure for obtaining superior products, and the yielding casting belts are deformed in an undesired manner by the molten metal without particular countermeasures. The invention, however, also ensures that, even in case the molten metal is introduced without pressure, particularly in the critical entrance zone of the mold chamber between the walls of the mold no unsealed locations may appear which would render necessary a premature interruption of the casting process. Similar to the entrance support rollers 12 the stationary support rollers 13 shown more detailed in FIG. 4*c* have a supporting length portion 13*a* which is composed of side-by-side arranged ribs 13*b* and which is shorter than the width B of the mold chamber 1. The ribs 13*b* (being in engagement with the casting belt portion 2*a* or 3*a* in the zone between the side dams 4) form an outwardly convex contour 13*c* which extends perpendicularly to the casting direction and is thus oriented parallel to the width B.

The outer portions 13*d* of the support rollers 13, which are situated in alignment with the side dams 4 relative to the casting belt portions 2*a* and 3*a*, additionally have support ribs 13*e* forming a cylindrical outer contour. The diameter of this outer contour is so dimensioned that the respective casting belt portion is held thereby on the side dams 4 permitting only a small play, if any.

The supporting effect of the support rollers 13 thus also extends—in contrast with the resiliently held entrance support rollers 12—to those casting belt portions which project beyond the width B of the mold chamber 1.

Figure 6:
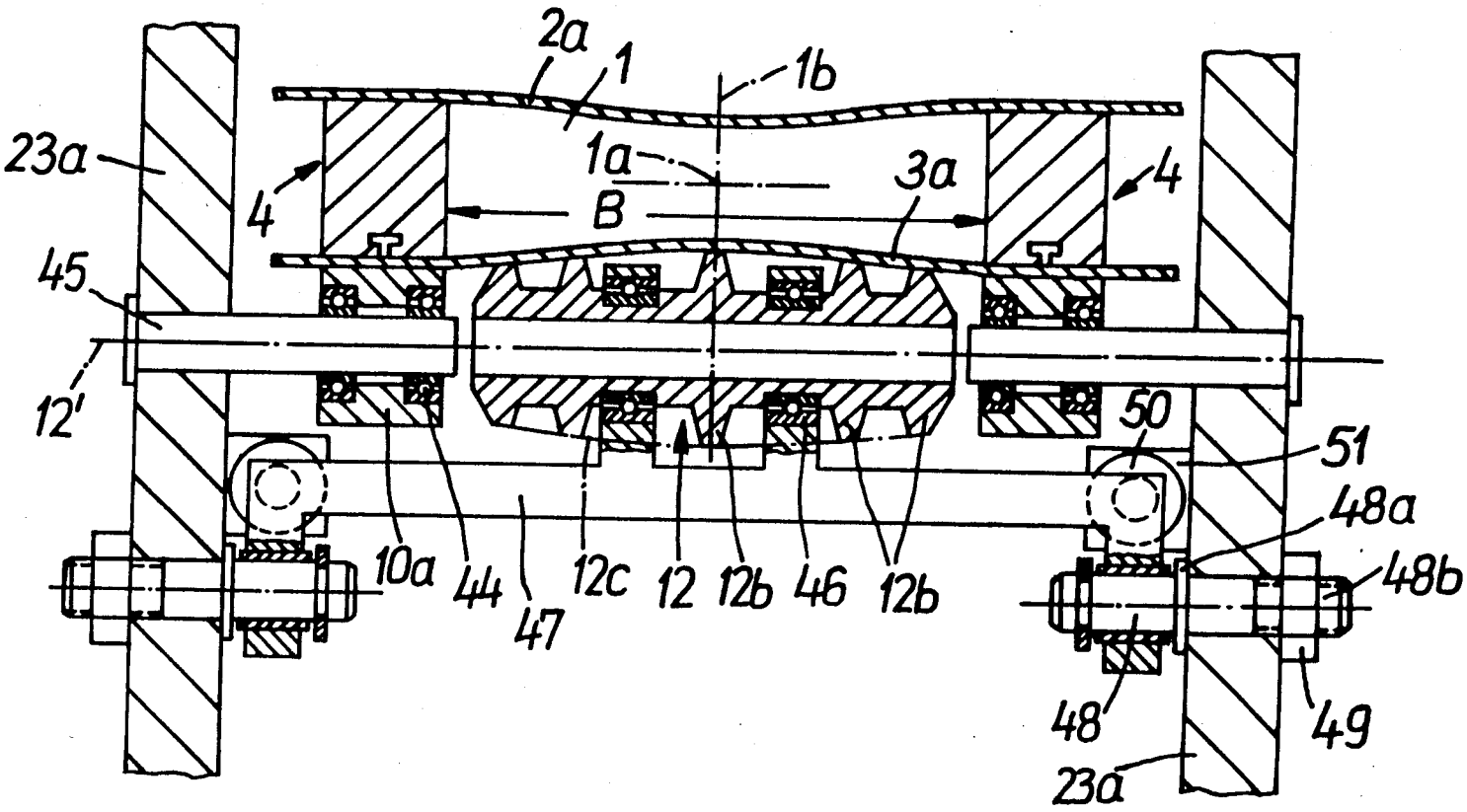
FIG. 6 is a front elevational view (similar to FIG. 4*b*) of an embodiment provided with short entrance support rollers and rolls acting as side dam support means.

In a departure form the embodiments described so far which are equipped with support rails 10, the preferred embodiment according to FIG. 6 has as side dam supports rolls 10*a* which maintain the casting belt portion 2*a* or 3*a* in contact with the side dams 4 and whose width corresponds at least approximately to the width of the side dams. The rolls 10*a* which are spaced closely along the twin-belt continuous casting mold are each held via two anti-frication bearings 44 on a support pin 45 which itself is fastened to the respective machine frame (i.e. in FIG. 6 to the lower frame 23*a*).

The rolls 10*a* serve as side dam supports whose contact area can follow the movement of the casting belt portions 2*a* or 3*a*.

The length of the entrance support rollers 12 working together with the rolls 10*a* is shorter than the width B of the mold chamber 1 or the length of the entrance support rollers 12 illustrated in FIG. 4*a*. The support ribs 12*b* similarly to those in FIG. 4*a*, jointly form the outwardly convex contour 12*c*.

Each of the short entrance support rollers 12 of the FIG. 6 embodiment is supported via two anti-friction bearings 46 on rockers 47 which are pivotable about rocker pins 48. The rocker pins, equipped with an internal shoulder 48*a* and an extenal thread section 48*b*, are stationarily connected by nuts 49 with the corresponding frame part.

The supporting force originating from the short entrance support rollers 12 is generated by spring elements 50 which are fixed between the respective rocker 47 and the brackets 51 mounred to the frame part.

For better understanding the casting belt portions 2*a*, 3*a* and the side dams 4 are illustrated in FIG. 6 turned through 90°: In reality the casting belt portions and side dams are so arranged that the mold chamber longitudinal axis 1*a* is parallel to the drawing plane. The mutual arrangement in reality is given by folding the parts 2*a*, 3*a* and 4 jointly clockwise around the axis of rotation 12' of the short entrance support roller 12 illustrated.

It will be understood that the above description of the present invention is susceptible to various modifications, changes and adaptations, and the same are intended to be comprehended within the meaning and range of equivalents of the appended claims.

What is claimed is:

1. In a twin-belt continuous casting mold including an elongated mold chamber defined by top, bottom and opposite lateral chamber walls travelling codirectionally in a casting direction; said mold chamber having a width dimension oriented perpendicularly to said casting direction; said top and bottom walls being constituted by a length portion of respective upper and lower endless casting belts supported by respective upper and lower upstream and downstream end drums as viewed in the casting direction; said mold chamber having an entrance adjacent the upstream end drums and an outlet adjacent the downstream end drums; said opposite lateral chamber walls being constituted by a length portion of respective segmented side dams; a guide assembly for the casting belts; said guide assembly including a plurality of support rollers arranged serially parallel to the casting direction and engaging each casting belt along said mold chamber, additional ribbed supports engaging each casting belt in a zone between a respective said upstream end drum and a respective first said support roller as viewed in the casting direction from said upstream end drums; said additional ribbed supports engaging each casting belt in a direction transverse to said casting direction for supporting said casting belts in a zone of said mold chamber and said side dams; the improvement wherein said support assembly comprises a first resilient holding means for positioning each said additional support and resiliently urging it into engagement with a respective said casting belt; each said additional ribbed support being constituted by a support carrier; said support rollers forming a first and a second group of support rollers; said first group of support rollers being situated in a zone of said entrance adjacent the respective said support carrier downstream thereof; a second resilient holding means for positioning each said support roller of said first group in a zone between said side dams for resiliently urging each said support roller of said first group into engagement with a respective said casting belt; said first and second resilient holding means comprising a plurality of rockers; a separate one of said rockers carrying said support carriers and the support rollers of said first group; each rocker having a stationarily supported horizontal pivot means for providing a swinging motion for each said rocker in a vertical plane; said second group of support rollers being situated downstream of said first group of support rollers and being rigidly held; each said roller of said first and second groups having a supporting portion provided with an arcuate outer contour being convex towards said mold chamber and being oriented parallel to said width dimensions; each said supporting portion being shorter than said width dimension; further comprising side dam support means extending parallel to said casting direction and flanking said support rollers of said first group and engaging a respective said casting belt in alignment with said side dams.

2. A twin-belt continuous casting mold as defined in claim 1, wherein said support carriers are coupled to rockers associated therewith by means of ball joints.

3. In a twin-belt continuous casting mold including an elongated mold chamber defined by top, bottom and opposite lateral chamber walls travelling codirectionally in a casting direction; said mold chamber having a width dimension oriented perpendicularly to said casting direction; said top and bottom walls being constructed by a length portion of respective upper and lower endless casting belts supported by respective upper and lower upstream and downstream end drums as viewed in the casting direction; said mold chamber having an entrance adjacent the upstream end drums and an outlet adjacent the downstream end drums; said opposite lateral chamber walls being constituted by a length portion of respective segmented side dams; a guide assembly for the casting belts; said guide assembly including a plurality of support rollers arranged serially parallel to the casting direction and engaging each casting belt along said mold chamber, additional ribbed supports engaging each casting belt in a zone between a respective said upstream end drum and a respective first said support roller as viewed in the casting direction from said upstream end drums; said additional ribbed supports engaging each casting belt in a direction transverse to said casting direction for supporting said casting belts in a zone of said mold chamber and said side dams; the improvement wherein said support assembly comprises a first resilient holding means for positioning each said additional support and resiliently urging it into engagement with a respective said casting belt; each said additional ribbed support being constituted by a support carrier; said support rollers forming a first and a second group of support rollers; said first group of support rollers being situated in a zone of said entrance adjacent the respective said support carrier downstream thereof; a second resilient holding means for positioning each said support roller of said first group in a zone between said side dams for resiliently urging each said support roller of said first group into engagement with a respective said casting belt; said second group of support rollers being situated downstream of said first group of support rollers and being rigidly held; each said roller of said first and second groups having a supporting portion provided with an arcuate outer contour being convex towards said mold chamber and being oriented parallel to said width dimension; each said supporting portion being shorter than said width dimension; further comprising side dam support means extending parallel to said casting direction and flanking said support rollers of said first group and engaging a respective said casting belt in alignment with said side dams; said side dam support means comprising support rails extending parallel to said casting direction and flanking said support rollers of said first group and engaging a respective said casting belt in alignment with said side dams.

4. In a twin-belt continuous casting mold including an elongated mold chamber defined by top, bottom and opposite lateral chamber walls travelling codirectionally in a casting direction; said mold chamber having a width dimension oriented perpendicularly to said casting direction; said top and bottom walls being constituted by a length portion of respective upper and lower endless casting belts supported by respective upper and lower upstream and downstream end drums as viewed in the casting direction; said mold chamber having an entrance adjacent the upstream end drums and an outlet adjacent the downstream end drums; said opposite lateral chamber walls being constituted by a length portion of respective segmented side dams; a guide assembly for the casting belts; said guide assembly including a plurality of support rollers arranged serially parallel to the casting direction and engaging each casting belt alont said mold chamber, additional ribbed supports engaging each casting belt in a zone between a respective said upstream end drum and a respective first said support roller as viewed in the casting direction from said upstream end drums; said additional ribbed supports engaging each casting belt in a direction transverse to said casting direction for supporting said casting belts in a zone of said mold chamber and said side dams; the improvement wherein said support assembly comprises a first resilient holding means for positioning each said additional support and resiliently urging it into engagement with a respective said casting belt; each said additional ribbed support being constituted by a support carrier; said support rollers forming a first and a second group of support rollers; said first group of support rollers being situated in a zone of said entrance adjacent the respective said support carrier downstream thereof; a second resilient holding means for positioning each said support roler of said first group in a zone between said side dams for resiliently urging each said support roller of said first group into engagement with a respective said casting belt; said second group of support rollers being situated downstream of said first group of support rollers and being rigidly held; each said roller of said first and second groups having a supporting portion provided with an arcuate outer contour being convex towards said mold chamber and being oriented parallel to said width dimension; each said supporting portion being shorter than said width dimension; further comprising side dam support means extending parallel to said casting direction and flanking said support rollers of said first group and engaging a respective said casting belt in alignment with said side dams; said side dam support means comprising support rolls flanking said support rollers of said first group and being coaxial therewith; said support rolls engaging a respective said casting belt in alignment with said side dams.

5. A twin-belt continuous casting mold as defined in claim 4, whrein each said support roll and each said side dam have a width dimension measured parallel to the width dimension of said mold chamber; the width dimension of each said support roll being substantially identical with the width dimension of each said side dam.

* * * * *